US007062198B2

(12) United States Patent
Oda

(10) Patent No.: US 7,062,198 B2
(45) Date of Patent: Jun. 13, 2006

(54) IMAGE FORMING APPARATUS

(75) Inventor: Yasuhiro Oda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/062,655

(22) Filed: Feb. 23, 2005

(65) Prior Publication Data

US 2006/0062591 A1 Mar. 23, 2006

(30) Foreign Application Priority Data

Sep. 17, 2004 (JP) ..... P2004-272468

(51) Int. Cl.
*G03G 15/00* (2006.01)

(52) U.S. Cl. ..... 399/107; 399/405

(58) Field of Classification Search ..... 399/107, 399/320, 400, 393, 388, 121, 122, 124, 397, 399/401, 405

See application file for complete search history.

(56) References Cited

U.S. PATENT DOCUMENTS 5,170,209 A * 12/1992 Tompkins et al. ..... 399/107
5,615,405 A * 3/1997 Yamaguchi ..... 399/125
6,125,248 A * 9/2000 Moser ..... 399/68
6,308,027 B1 * 10/2001 Obu et al. ..... 399/110
6,542,715 B1 * 4/2003 Miyamoto et al. ..... 399/405
6,907,209 B1 * 6/2005 Abe ..... 399/107
6,928,251 B1 * 8/2005 Yoshihara et al. ..... 399/107

FOREIGN PATENT DOCUMENTS

| | | |
|---|---|---|
| JP | 4-274264 | 9/1992 |
| JP | 2002-148983 | 5/2002 |
| JP | 3470696 B | 9/2003 |
| JP | 2003-307964 | 10/2003 |

* cited by examiner

*Primary Examiner*—David M. Gray
*Assistant Examiner*—Ruth N. LaBombard
(74) *Attorney, Agent, or Firm*—Morgan, Lewis & Bockius LLP

(57) ABSTRACT

An image forming apparatus includes: an image generating engine for forming a toner image and transferring the toner image onto a recording material in a transfer region; an upper supply tray disposed above the image generating engine and accommodating the recording material; and a fixing unit for thermally fixing the toner image transferred on the recording material in the transfer region of the image generating engine. The fixing unit is disposed between the image generating engine and the upper supply tray and includes a thermal fusing unit positioned at a location closer to a center of a case body of the image forming apparatus than sidewalls of the case body.

11 Claims, 10 Drawing Sheets

IMAGE FORMING APPARATUS

BACKGROUND OF THE INVENTION

1. Field of the Invention

The present invention relates to an image forming apparatus such as a copy machine or a printer employing an electrophotography method or an electrostatic recording method, and more particularly to an improvement of an image forming apparatus (mainly, effective as an intermediate transfer type image forming apparatus) having a configuration that toner images formed by an image generating engine are transferred on a recording material and then the toner images are thermally fixed by a fixing unit.

2. Description of the Related Art

As one example of conventional image forming apparatuses, there has been known an intermediate transfer type color image forming apparatus in which each color component toner image formed on an image forming carrier such as a photoconductor drum is primarily transferred on an intermediate transfer body sequentially, and multicolor toner images on the intermediate transfer body are collectively transferred on a recoding material such as paper by a secondary transfer unit.

Recently, there has been a keen need of high speed operation, miniaturization, and saving energy for such a color image forming apparatus.

Particularly for the high speed operation of the color image forming apparatus, although a tandem structure where color image forming units for forming color component toner images are arranged in parallel on an intermediate transfer belt is effective, there is a problem in that the color image forming apparatus may become big under such a structure where the color image forming units are arranged in parallel and a fixing unit is placed on the elongation thereof.

As a measure against this problem, for example, as shown in FIG. 10, there has been proposed a technique where an intermediate transfer belt 201 is obliquely arranged, image forming units 202 (202*a* to 202*d*) are arranged in parallel along an upper inclined plane of the intermediate transfer belt 201, a collective transfer unit (for example, a collective transfer roll) 203 is arranged at a lower end portion of the intermediate transfer belt 201, and a fixing unit 204 is arranged in a space under the obliquely arranged intermediate transfer belt 201, (for example, see Japanese Patent No. 3470696).

According to the above mentioned technique, since the dimension in the width direction of the image generating engine (the image forming units 202 and the intermediate transfer belt 201) is suppressed, the fixing unit 204 is arranged under the image generating engine, and the image forming units 202 are not arranged in parallel to the fixing unit 204, the dimension in the width direction of the image forming apparatus can be set to be short, thus allowing the implementation of a miniaturized image forming apparatus.

However, according to such a conventional image forming apparatus, since the fixing unit 204 is arranged under the image generating engine, heat generated from the fixing unit 204 when it operates for a long time has an influence on the image forming units 202 located above the fixing unit 204. This may lead to deterioration of image quality, such as toner fusion due to the heat, in the image forming units 202. In order to overcome this problem, it is necessary to arrange a heat reflection plate 205 between the fixing unit 204 and the intermediate transfer belt 201 or to provide an exhaust system (not shown) such that the heat generated from the fixing unit 204 is not moved to the image forming units 202. As a result, the structure of the image forming apparatus is more complicated.

As mentioned above, when the heat reflection plate 205 or the exhaust system is used, since some of energy used for the fusion by the fixing unit 204 is exhausted to the outside, thermal energy efficiency of the fixing unit 204 is apt to be insufficient.

In addition, for such a conventional color image forming apparatus, a recording material supply tray (not shown) is commonly disposed under the image generating engine in respect that a recording material 206 passes through the collective transfer unit 203 located at the lower end portion of the image generating engine and the fixing unit 204 located under the image generating engine. In this case, since the recording material supply tray is disposed near a lower portion of a case body of the image forming apparatus, and therefore, a user must crouch or stoop down when he replenishes the recording material supply tray with the recording material, thus giving him an inconvenience.

There has been conventionally proposed another image forming apparatus in which the image generating engine and the fixing unit are disposed in a lower region within the image forming apparatus case body, an upper recording material supply tray is disposed in an upper region within the image forming apparatus case body, and the recording material is introduced from the upper recording material supply tray into the image generating engine and the fixing unit through a roughly S-shaped carrying path (for example, see JP-A-4-274264 (embodiments, FIG. 1)).

With this apparatus, while standing, a user can more easily replenish the upper recording material supply tray with the recording material since the upper recording material supply tray is disposed at the upper portion of the image forming apparatus case body.

However, in this apparatus, since the S-shaped carrying path of the recording material extends long from the upper recording material supply tray to the image generating engine and the fixing unit, time taken until output of the recording material (First Copy Output Time: FCOT) from an initial image generating operation is prolonged, and, moreover, the fixing unit is unavoidably disposed near the image forming apparatus case body. Accordingly, the heat generated from the fixing unit is apt to exhaust to the outside of the image forming apparatus, which results in much heat loss and hence a poor energy efficiency of the fixing unit.

Since most of the heat generated from the fixing unit is exhausted to the outside of the image forming apparatus, the disposition location of the upper recording material supply tray does not reach a region immediately above the fixing unit, and the fixing unit is very distant from the upper recording material supply tray, it is not nearly expected that the heat generated from the fixing unit preliminarily heats the recording material within the upper recording material supply tray. On this account, heat of the fixing unit is much dispossessed by the recording material in a fusing process by the fixing unit, thus resulting in increase in energy consumption of the fixing unit.

SUMMARY OF THE INVENTION

The present invention has been made in view of the above circumstances and provides an image forming apparatus, which is capable of easily replenishing with recording materials, and realizing miniaturization, high speed operation, and saving energy (mainly, of a fixing unit) of the image forming apparatus.

According to a first aspect of the invention, an image forming apparatus includes: an image generating engine for forming a toner image and transferring the toner image onto a recording material in a transfer region; an upper supply tray disposed above the image generating engine and accommodating the recording material; and a fixing unit for thermally fixing the toner image transferred on the recording material in the transfer region of the image generating engine. The fixing unit is disposed between the image generating engine and the upper supply tray and includes a thermal fusing unit positioned at a location closer to a center of a case body of the image forming apparatus than sidewalls of the case body.

DETAILED DESCRIPTION OF THE INVENTION

Figure 1A:
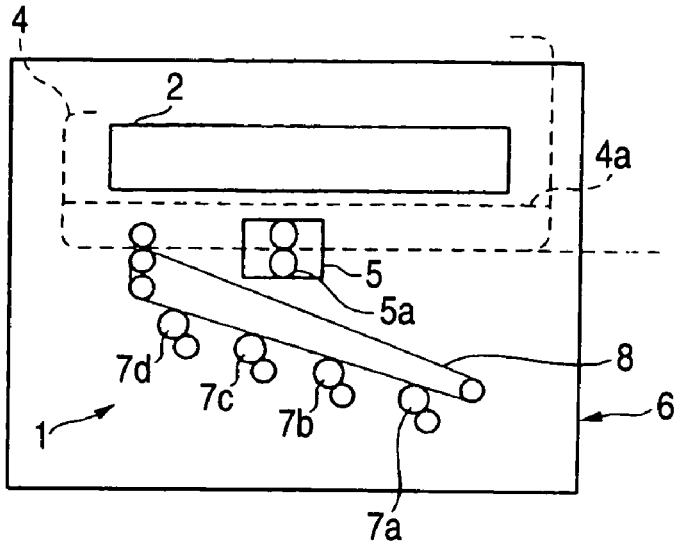
FIG. 1A is an explanatory diagram illustrating an outline of an image forming apparatus according to the present invention.
Figure 1B:
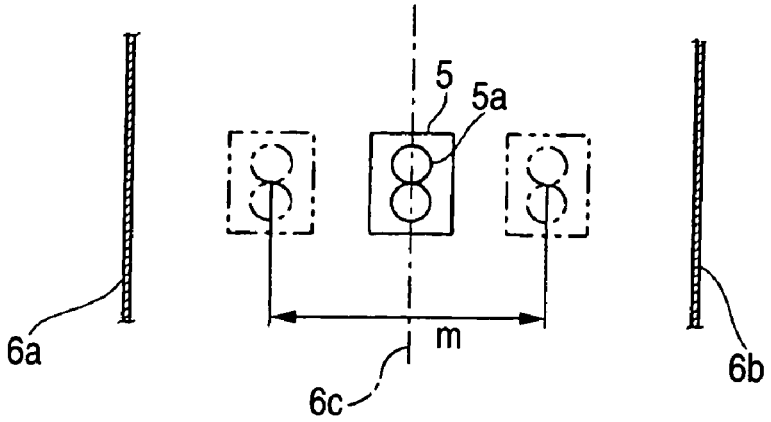
FIG. 1B is an explanatory diagram illustrating disposable positions of a fixing unit.

As shown in FIGS. 1A and 1B, the present invention provides an image forming apparatus including an image generating engine 1 for forming a toner image and transferring the toner image onto a recording material in a transfer region; an upper supply tray 2 disposed above the image generating engine 1, for accommodating the recording material; and a fixing unit 5 for thermally fixing the toner image transferred on the recording material in the transfer region of the image generating engine 1, the fixing unit 5 being disposed between the image generating engine 1 and the upper supply tray 2 and having at least a thermal fusing unit 5*a* positioned at a location closer to the center of an image forming apparatus case body 6 than sidewalls 6*a* and 6*b* of the image forming apparatus case body 6.

In the above configuration, an image generating method of the image generating engine 1 is not limited to an electrophotography method, and may include an electrostatic recording method as long as the toner images can be generated. In addition, the image generating method may be applied to either single color images or multi-color images.

The upper supply tray 2 should be disposed only above the image generating engine 1, and may have any number and size. In addition, if an image read unit is disposed above the upper supply tray 2, the image forming apparatus can be used as a copy machine.

The fixing unit 5 may employ either a contact heating system or a non-contact heating system as long as the toner images can be thermally fused. In addition, as the heating system, any of a heater system, such as a heating lamp, and an electromagnetic induction system may be properly selected and used. In addition, as the fixing unit 5, an instant-on type fixing unit may be used in respect that useless heat is not generated in the fixing unit (for example, see JP-A-2003-307964 and JP-A-2002-148983).

With the configuration that the fixing unit 5 is disposed between the image generating engine 1 and the upper supply tray 2, heat emitted upward from the fixing unit 5 can be effectively used for preliminary heating on the recording material accommodated in the upper supply tray 2, and is difficult to have an effect on the image generating engine 1 at a below side of the fixing unit 5.

The configuration that the fixing unit 5 has at least a thermal fusing unit 5*a* positioned at a location closer to the center of an image forming apparatus case body 6 than sidewalls 6*a* and 6*b* of the image forming apparatus case body 6 aims to include all aspects (a range of m in FIG. 1B) that, when the fixing unit 5 is disposed in the image forming apparatus, the thermal fusing unit 5*a* is positioned at a location closer to the center 6*c* of an image forming apparatus case body 6 than sidewalls 6*a* and 6*b* of the image forming apparatus case body 6, for the purpose of isolating the thermal fusing unit 5*a* from the sidewalls 6*a* and 6*b* of the case body 6. In this case, a case of the fixing unit 5 may be located at the sidewalls 6*a* and 6*b* of the case body 6.

According to this aspect of the present invention, thermal energy exhausted out of the image forming apparatus can be reduced and thermal energy for preliminary heating on the recording material accommodated in the upper supply tray 2 can be effectively used, which results in enhancement of energy efficiency.

The fixing unit 5 may be disposed immediately above the image generating engine 1. With this configuration, increase of an installation area of the image forming apparatus according to the layout of the fixing unit can be effectively avoided, thus allowing miniaturization of the image forming apparatus.

At least thermal fusing unit 5*a* of the fixing unit may be disposed immediately below the upper supply tray 2. With this configuration, heat from the fixing unit 5 can efficiently preliminarily heat the recording material accommodated in the upper supply tray 2.

In these configurations of the present invention, "the region immediately above the image generating engine 1" or "the region immediately below the upper supply tray 2" is a region when viewed from the front of the image forming apparatus (a direction perpendicular to a process progression direction). When viewed from the process progression direction, a portion of the fixing unit 5 may be thrust out of a projected region of disposition region of the image generating engine 1 or the upper supply tray 2.

Particularly, in the present invention, the fixing unit 5 may be disposed closer to the transfer region of the image generating engine 1 with respect to the center 6*c* of the case body 6. In this case, the length of the carrying path 4 from the upper supply tray 2 to the fixing unit 5 can be set to shorter, thus allowing reduction of FCOT.

In the carrying path 4 of the recording material, a feeding direction of the recording material from the upper supply tray 2 may be opposite to an exit direction of the recording material from the fixing unit 5. In this case, since the carrying path 4 of the recording material is effectively disposed in a space between the image generating engine 1 and the upper supply tray 2, the length of the carrying path can be shortened, without using an S-shaped carrying path.

From another view point, a carrying path 4 of the recording material from the upper supply tray 2 may be disposed to traverse between the upper supply tray 2 and the image generating engine 1.

For double sided recording, a carrying path downstream of the fixing unit 5 may have a reverse carrying path 4*a* through which the recording material is returned in a reversed state to an upstream side of the transfer region of the image generating engine 1, at least a portion of the reverse carrying path 4*a* being disposed between the upper supply tray 2 and the image generating engine 1.

An exit tray for the recording material may be provided downstream of the fixing unit 5, the exit tray being disposed on the opposite side of a recording material supply direction of the upper supply tray 2. With this configuration, a recording material output receiving unit can be configured without enlarging the height dimension of the image forming apparatus case body 6.

An exit tray for the recording material may be provided downstream of the fixing unit 5, the exit tray being disposed above the upper supply tray 2 or between plural upper supply trays 2. With this configuration, the exit tray does not project to the outside of the image forming apparatus case body 6, and it is possible to draw out a recording material from the top of the image forming apparatus case body 6.

The image generating engine 1 may include an image forming carrier 7 for forming and carrying the toner image and an intermediate transfer body 8 on which the toner image carried on the image forming carrier 7 is temporarily transferred in an intermediate step before the toner image is transferred on the recording material.

In this case, although the number of image forming carrier 7 may be one or plural, for a high speed operation, the image forming carrier may have a tandem configuration that plural image forming carriers 7 (7*a* to 7*d*) are disposed in parallel, the color component toner images are formed on the image forming carriers 7 and then are sequentially transferred on the intermediate transfer body 8. In addition, the intermediate transfer body 8 may be formed of a belt-shaped member in respect of a degree of freedom of layout or miniaturization, although it may have either a belt shape or a drum shape.

As a layout of an intermediate transfer type color image forming apparatus, the image forming carrier 7 may be disposed on the opposite side of the fixing unit 5 from the intermediate transfer body 8 interposed therebetween. With this configuration, heat from the fixing unit 5 can be shielded by the intermediate transfer body 8.

The intermediate transfer body 8 may be a belt member and may include a secondary transfer unit at a recording material feeding side from the upper supply tray 2, the intermediate transfer body 8 being hung spaced apart from the fixing unit 5 so as to substantially horizontally dispose the secondary transfer unit and the thermal fusing unit 5*a* of the fixing unit 5.

In this case, since the secondary transfer unit of the intermediate transfer body 8 and the thermal fusing unit 5*a* of the fixing unit 5 can be substantially horizontally disposed, interference between the intermediate transfer body 8 and the fixing unit 5 can be avoided. In addition, since the carrying path 4 between the secondary transfer portion and the thermal fusing unit 5*a* becomes straight, FCOT can be shortened.

Particularly, the intermediate transfer body 8 formed of the belt-member may be obliquely disposed with respect to the image forming apparatus case body 6 in such a manner that the recording material feeding side from the upper supply tray 2 is elevated. In this way, when the intermediate transfer body 8 is obliquely disposed in a certain direction, the secondary transfer portion and the thermal fusing unit can be substantially horizontally disposed without making the disposition of the intermediate transfer body 8 complicated, and moreover, a tandem type image forming apparatus may be further miniaturized.

According to the aspects of the present invention, since the upper supply tray is disposed above the image generating engine, and the fixing unit is disposed between the image generating engine and the upper supply tray and near the center of the image forming apparatus case body, the following basic effects can be achieved.

First, since the image generating engine is disposed below the fixing unit, heat from the fixing unit has little effect on the image generating engine, thereby the toner images can be stably generated by the image generating engine. Particularly, it is effective for an intermediate transfer type image forming apparatus since the intermediate transfer body can be used as a heat shielding member.

Second, since the fixing unit is disposed near the center of the image forming apparatus case body, unnecessary exhaustion of heat from the fixing unit to the outside of the image forming apparatus can be prevented, thus suppressing thermal loss of the fixing unit.

Third, since the fixing unit is disposed below the upper supply tray and near the center of the image forming apparatus case body, heat generated from the fixing unit can preliminarily heat the recording material accommodated in the upper supply tray, thus reducing fusion energy and simplifying or excluding a fan for exhausting heat. Accordingly, high energy efficiency of the fixing unit can be maintained.

Fourth, since the upper supply tray can be disposed in the upper region of the image forming apparatus, a user-comfortable image forming apparatus can be provided in that a user can replenish the upper supply tray with recording material without taking an uncomfortable posture such as crouching or stooping down.

Fifth, since the fixing unit is disposed between the upper supply tray and the image generating engine and near the center of the image forming apparatus case body, the length of the carrying path extending from the upper supply tray to the fixing unit can be easily shortened, thereby making short a time taken until the recording material is output from a beginning operation.

Hereinafter, the present invention will be described in detail through embodiments in conjunction with the accompanying drawings.

Figure 2:
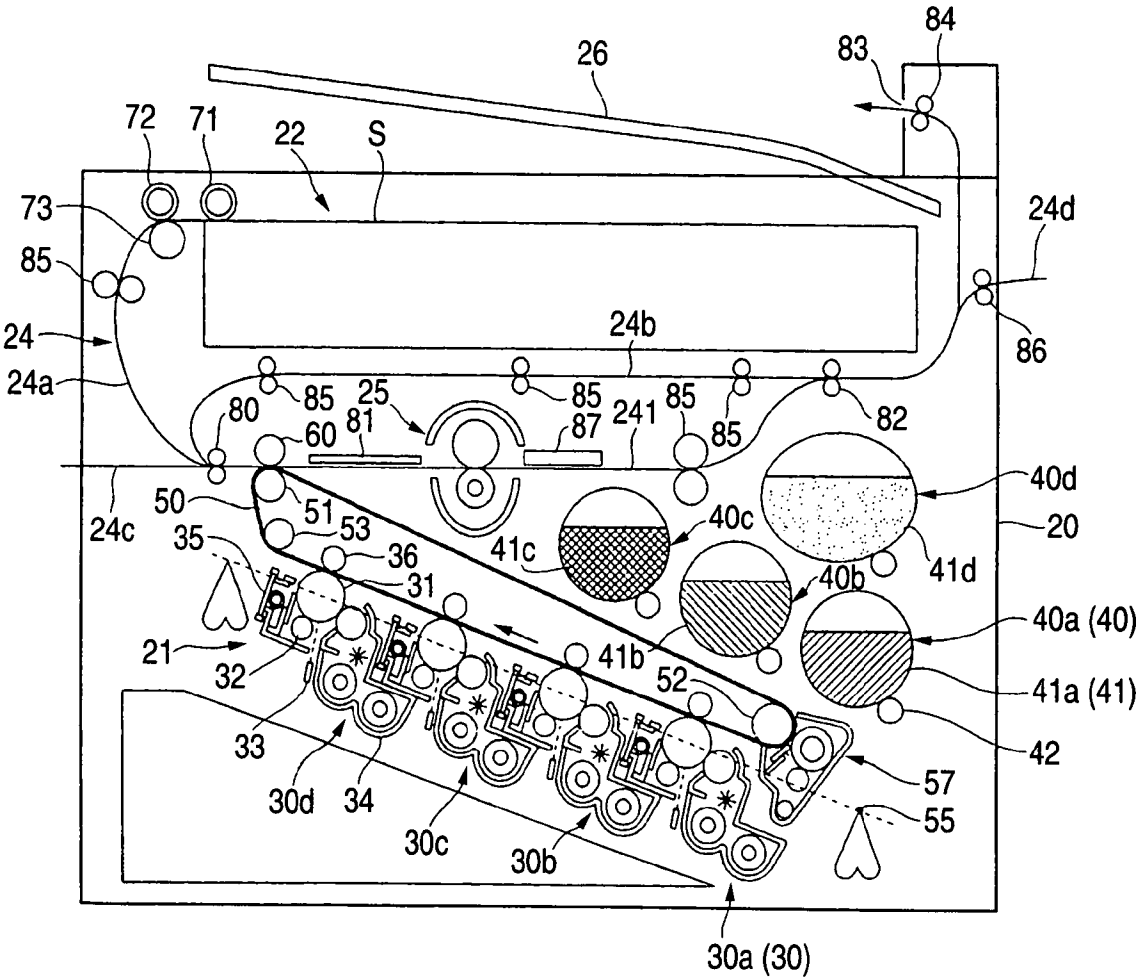
FIG. 2 is an explanatory diagram illustrating a first embodiment of an image forming apparatus to which the present invention is applied.

FIG. 2 is a schematic diagram illustrating a first embodiment of an image forming apparatus to which the present invention is applied.

In the figure, the image forming apparatus is an intermediate transfer type tandem machine and includes, within an image forming apparatus case body (hereinafter, also referred to as an apparatus body, if necessary) 20, an image generating engine 21 for generating yellow (Y), magenta (M), cyan (C), and black (K) color component toner images, an upper supply tray 22 disposed above the image generating engine 21 to supply a recording material S, and a fixing unit 25 disposed between the image generating engine 21 and the upper supply tray 22.

In this embodiment, the image generating engine 21 is obliquely disposed in a form of a module in such a manner that the left side of the figure is an upper portion of the image generating engine 21, and is movable around a rotating support axis 55 provided in the right bottom side of the figure.

The image generating engine 21 has four electrophotographic image forming units 30 (30*a* to 30*d*) arranged in parallel to generate the color component toner images, and an intermediate transfer belt 50 contacting with the image forming units 30.

In this embodiment, particularly, the intermediate transfer belt 50 is obliquely disposed in such a manner that the left side of the figure is an upper portion of the intermediate transfer belt 50, and the image forming units 30 are disposed with steps therebetween along a lower inclined plane of the intermediate transfer belt 50.

Figure 3:
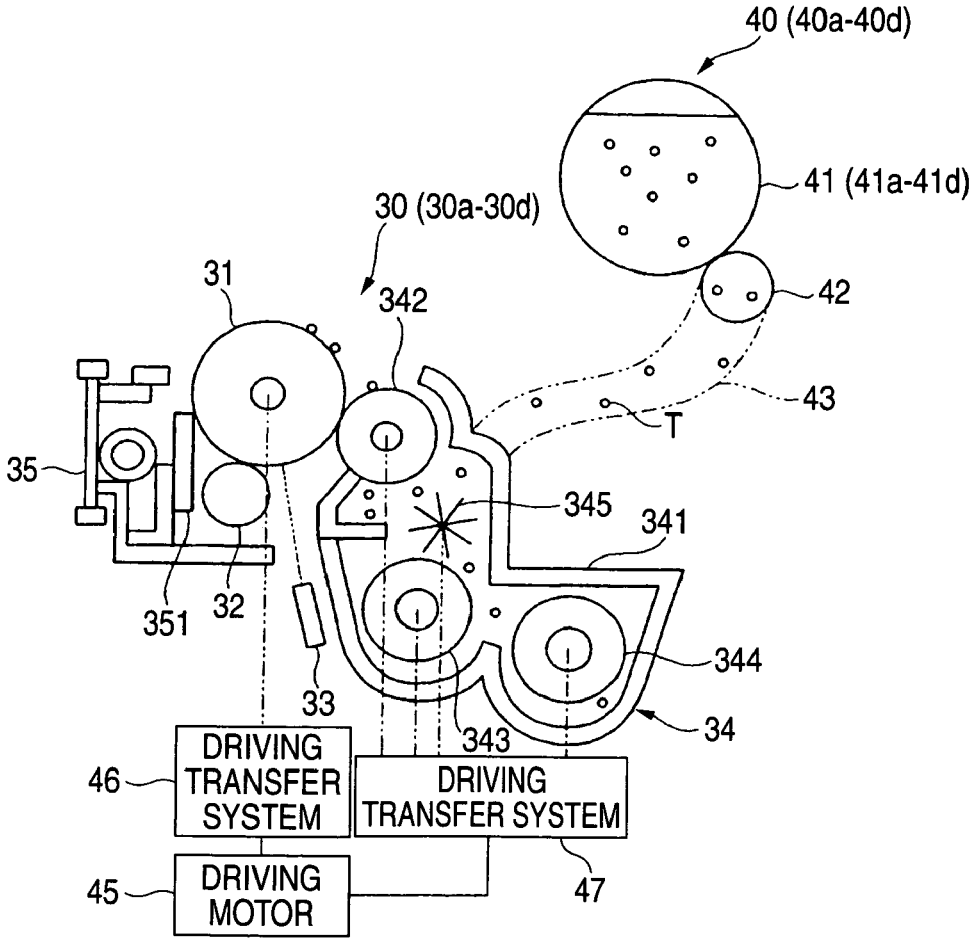
FIG. 3 is an explanatory diagram illustrating the details of an image forming unit employed for the first embodiment.

As shown in FIGS. 2 and 3, the image forming units 30 have respective photoconductor drums 31 rotating in a predetermined direction. Around each photoconductor drum 31 are arranged a charging unit (a charging roll in this embodiment) 32 for charging the photoconductor drum 31, an exposure unit 33 for recording an electrostatic latent image on the charged photoconductor drum 31, a developing unit 34 for developing the electrostatic latent image on the photoconductor drum 31 with a predetermined color toner, and a drum cleaner 35 (employing a cleaning method by a blade 351 in this embodiment) for cleaning residual toners on the photoconductor drum 31.

The developing unit 34 includes a housing 341 having an opening facing the photoconductor drum 31 and having, for example, two component developing agent accommodated therein, a developing roll 342 disposed at the opening of the housing 341, agitating and carrying augers 343 and 344 disposed at the backside of the developing roll 342 for agitating the developing agent, and a supply paddle 345 disposed between the agitating and carrying auger 343 and the developing roll 342 for supplying the developing agent.

A driving force from a driving motor 45 is transferred to the photoconductor drum 31 via a driving transfer system 46 such as a gear. Similarly, the driving force from the driving motor 45 is transferred to the developing roll 342, the agitating and carrying augers 343 and 344 and the supply paddle 345 via a driving transfer system 47 such as a gear.

Toner replenishing units 40 (specifically, 40*a* to 40*d*) are attached to the developing units 34 of the image forming units 30 (30*a* to 30*d*), respectively.

The toner replenishing unit 40 has a cartridge receiver above the intermediate transfer belt 50 in the apparatus case body 20. A toner cartridge 41 (41*a* to 41*d*) in which the color component (YMCK) toner is accommodated is detachably mounted in the cartridge receiver. Also, a reserve tank 42 in which the toner within the toner cartridge 41 is temporarily accommodated is disposed at a portion contacting with the cartridge receiver. The reserve tank 42 is connected to a housing 341 of the developing unit 34 via a toner replenishing duct 43. In FIG. 2, the toner replenishing duct 42 is not shown for the purpose of avoiding the complexity of the figure.

Particularly, in this embodiment, of the toner replenishing units 40 (40*a* to 40*d*), a toner cartridge 41*d* for a black (K) color is set to be larger than toner cartridges 41*a* to 41*c* for other colors (YMC). The toner cartridges 41*a* to 41*c* for the YMC colors are arranged in parallel along the upper inclined plane of the intermediate transfer belt 50 and at a location spaced apart from the fixing unit 25. The toner cartridge 41*d* for the K color is arranged above the toner cartridges 41*a* to 41*c* for the YMC colors and at a location spaced apart from the fixing unit 25.

In this embodiment, the intermediate transfer belt 50 is an endless belt made of a polyimide mixed with conductive carbon black and having volume resistivity of an order of $10^9$ to $10^{12}$ Ω·cm. The intermediate transfer belt 50 is placed on three hanger rolls 51 to 53, for example, and is moved in an arrow direction in the figure, with a hanger roll 52 as a driving roll and a hanger roll 53 as a tension roll, for example. Reference numeral 57 denotes a belt cleaner for cleaning residual toner on the intermediate transfer belt 50.

Primary transfer units (primary transfer rolls in this embodiment) 36 are arranged at the backside of the intermediate transfer belt 50 facing the photoconductor drums 31 of the image forming units 30, respectively. In addition, a secondary transfer unit (a secondary transfer roll in this embodiment) 60 is arranged at the portion opposing to the hanger roll 51 which is an upper end portion of the intermediate transfer belt 50. In addition, a secondary transfer bias (not shown) is applied, with the hanger roll 51 as a backup roll.

In this embodiment, the upper supply tray 22 is disposed at an upper portion of the apparatus case body 20 in the horizontal direction of the figure, and an exit tray 26 for discharging and accommodating the recording material S is disposed on the top of the apparatus case body 20.

The upper supply tray 22 includes a pickup roll 71 for processing the recording material S one by one, disposed in a feeding direction of the recording material S, a feed roll 72 for generating a carrying force, disposed in the downstream of the recording material feeding direction of the pickup roll 71, and a retard roll 73 for processing the recording material S one by one, facing the feed roll 72 in such a manner that the retard roll 73 can be rotated contacting with the feed roll 72.

The carrying path 24 of the recording material S from the upper supply tray 22 is composed of a normal carrying path 24*a* along which the recording material S having one side recorded by the image generating engine 21 reaches the exit tray 26 and an reverse carrying path 24*b* bypassing the normal carrying path 24*a*.

The normal carrying path 24*a* is curved in a U-shape from a side end in the recording material feeding direction of the upper supply tray 22 and has a horizontal carrying path 241 extending in a substantially horizontal direction between the upper supply tray 22 and the image generating engine 21. The normal carrying path 24*a* is inclined from an end point of the horizontal carrying path 241 such that it avoids the toner cartridge 41*a* for the K color, and then reaches the exit tray 26 toward an upper portion of a side end in a recording material non-feeding direction of the upper supply tray 22. A proper number of carrying rolls 85 are disposed on the normal carrying path 24*a*. A resist roll 80 for positioning the recording material S is disposed immediately before the upstream of the secondary transfer unit 60 in the horizontal carrying path 241 of the normal carrying path 24*a*. The fixing unit 25 is disposed downstream of the secondary transfer unit 60 via a carrying belt 81. In addition, a reversible carrying roll 82 is disposed downstream of the horizontal carrying path 241 and an exit roll 84 is disposed immediately before an exit port 83 in the normal carrying path 24*a*.

In this embodiment, the carrying belt 81 may employ an electrostatic adsorption method or an air absorption method and serves to prevent deterioration of image quality of non-fused toner transferred on the recording material S by the secondary transfer unit 60.

On the other hand, the reverse carrying path 24*b* is branched at the disposition location of the reverse carrying roll 82 of the normal carrying path 24*a*, traverses between the upper supply tray 22 and the image generating engine 21, and reaches the upstream of the resist roll 80. In addition, a proper number of carrying rolls 85 are disposed on the reverse carrying path 24*b*.

In this embodiment, as the carrying path 24, a manual carrying path 24*c* from a manual tray (not shown) is connected to the upstream of the resist roll 80 of the normal carrying path 24*a*. Also, a branch carrying path 24*d* is branched downstream of the reverse carrying roll 82 of the normal carrying roll 24*a* in such a manner that the branch carrying path 24*d* can be switched over by a switching gate (not shown), and extends to a sidewall opening of the apparatus case body 20 located at the backside of the upper supply tray 22. At a downstream end of the branch carrying path 24*d* is provided a side exit tray (not shown) or a post-processing apparatus (including post-processing units such as a stapler, a puncher and a folding tool), and an exit roll 86 is disposed downstream of the branch carrying path 24*d*.

Figure 4:
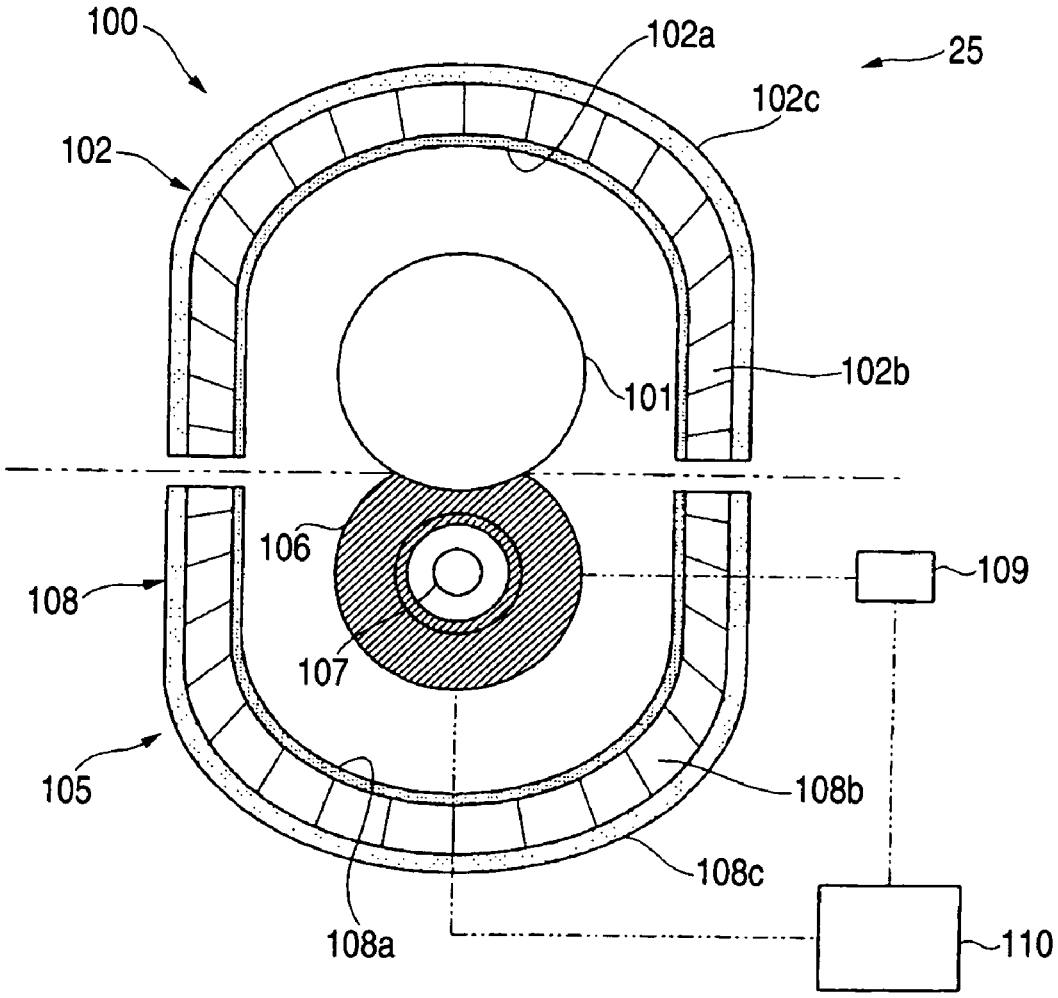
FIG. 4 is an explanatory diagram illustrating the details of a fixing unit employed for the first embodiment.

In this embodiment, as shown in FIGS. 2 and 4, the fixing unit 25 is disposed downstream of the secondary transfer unit 60 on the horizontal carrying path 241 and is composed of an upper fixing unit 100 and a lower fixing unit 105. The upper fixing unit 100 has a pressing roll 101 and a heat shield cover 106 covering the periphery of the pressing roll 101, and the lower fixing unit 105 has a heat roll 106 containing a heater 107 therein and a heat shield cover covering the periphery of the heat roll 106.

Here, the pressing roll 101 is formed of an elastic roll having a metal wick, with an elastic layer such as a urethane rubber formed on a surface of the metal wick, for example. In addition, the heat roll 106 is also formed of an elastic roll having a metal wick, with an elastic layer such as a urethane rubber formed on a surface of the metal wick, and with a release layer formed on a surface of the elastic layer, for example. In addition, the pressing roll 101 presses against the heat roll 106 in such a manner that the pressing roll 101 can be rotated contacting with the heat roll 106. In addition, a substantially horizontally elongated and convex nip region is formed between both rolls 101 and 106, and the recording material, which passed through the nip region, is easily peeled.

However, the configuration of the pressing roll 101 and the heat roll 106 is not particularly limited thereto.

In addition, the heat shield covers 102 and 108 have metal heat radiation plates 102*a* and 108*a* provided at the pressing roll 101 and heat roll 106 sides, respectively, with the outsides of the metal heat radiation plates 102*a* and 108*a* covered with vacuum adiabatic materials 102*b* and 108*b*, respectively, and again, with the outsides of the vacuum adiabatic materials 102*b* and 108 covered with plastic sheathing covers 102*c* and 108*c*, respectively.

In addition, in connection with temperature control of the heater 107, a surface temperature of the heat roll 106 is sensed by a temperature sensor 109 and is supplied to a control unit 110, and the control unit 110 controls switching on/off of the heater 107 based on the sensed surface temperature.

In this embodiment, for example, polished metal such as aluminum is used as the heat radiation plates 102*a* and 108*a*. The heat radiation plates 102*a* and 108*a* have surfaces of thermal radiation rate of less than 0.5 so that reflectivity at the surfaces is increased. In addition, each vacuum adiabatic material 102*b* and 108*b* is formed of a member having thermal conductivity of less than 0.03 W/(M·K) and thickness of more than 3 mm. In addition, each sheathing cover 102*c* and 108*c* is formed of plastic having low thermal conductivity.

In this embodiment, a distance between the pressing roll 101 and the heat shield cover 102 and a distance between the heat roll 106 and the heat shield cover 108 are 3 to 20 mm, for example. The heat shield covers 102 and 108 have such a shape that the pressing roll 101 and the heat roll 106 can be inserted in the heat shield covers 102 and 108 from the top and bottom directions, respectively. On this account, heat generated from the heat roll 106 does not leak out of the fixing unit 25.

In this embodiment, as shown in FIG. 2, a cooling plate 87 is disposed downstream of the fixing unit 25. The cooling plate 87 serves to lower temperature of the recording material after the recording material is fused by the fixing unit 25, in order to accelerate solidification of the fused toner. Of course, this cooling plate may not be used.

Figure 5:
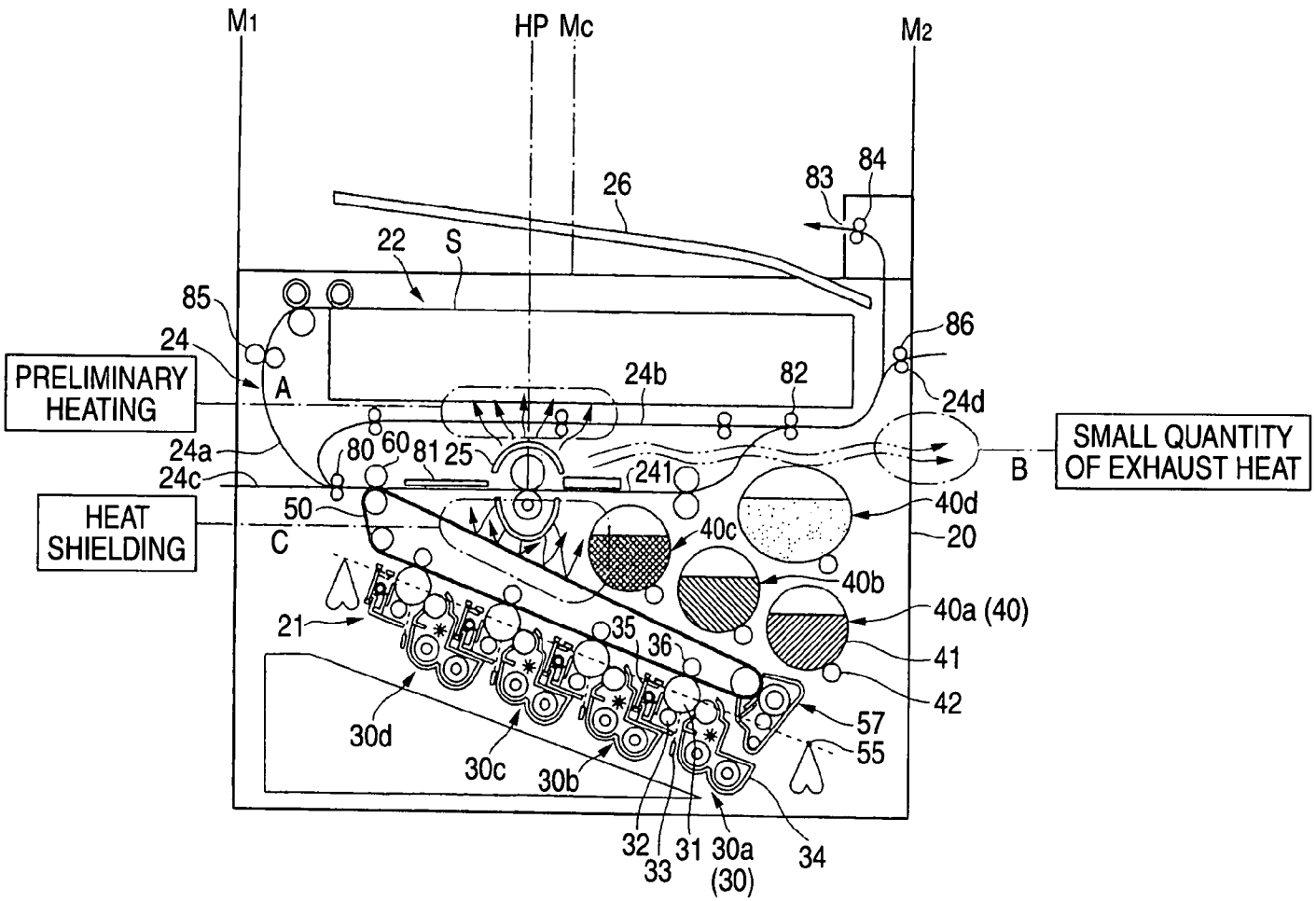
FIG. 5 is an explanatory diagram schematically illustrating operation of the image forming apparatus according to the first embodiment.

In this embodiment, as shown in FIG. 5, for example, the nip region (corresponding to a thermal fusing unit HP) of the pressing roll 101 and the heat roll 106 of the fixing unit 25 is located near the center Mc of the apparatus case body 20, rather than sidewalls M1 and M2 of the apparatus case body 20.

In this embodiment, the fixing unit 25 is disposed immediately above the image generating engine 21 and immediately below the upper supply tray 22, when viewed from the front of the image forming apparatus.

Particularly, in this embodiment, the fixing unit 25 is disposed near a secondary transfer region of the image generating engine 21, with respect to the center Mc of the apparatus case body 20.

Next, operation of the image forming apparatus according to this embodiment will be described.

When image data of the color component (yellow (Y), magenta (M), cyan (C), and black (K)) images are transferred to the exposure unit 33 of the image forming units 30 (30*a* to 30*d*), respectively, the electrostatic latent image for each color is formed on the photoconductor drum 31 of each image forming unit 30 and is developed by each developing unit 34 in which a corresponding color toner is accommodated, and each non-fused color component toner image is formed on the photoconductor drum 31.

The color component toner images are overlapped on a primary transfer region at which each photoconductor drum 31 contacts with the intermediate transfer belt 50 as the color component toner images are sequentially transferred on the intermediate transfer belt 50 by the primary transfer roll 36.

In this way, the color component toner images primarily transferred on the intermediate transfer belt 50 are moved to the secondary transfer region (formed by the secondary transfer roll 60 and the hanger roll 51) as the intermediate transfer belt 50 is moved.

On the other hand, the recording material S is sequentially fed from the upper supply tray 22 to the normal carrying path 24*a* at a predetermined timing. The recording material S carried on the normal carrying path 24*a* is carried to the secondary transfer region after aligned by the resist roll 80, and the color component toner images on the intermediate transfer belt 50 are collectively transferred (secondarily transferred) on the recording material S by the secondary transfer roll 60.

The recording material S having the color component toner images collectively transferred thereon is absorbed and carried by the carrying belt 81 and reaches the fixing unit 25 by which the non-fused toner images are fused.

Thereafter, the recording material S which passed through the fixing unit 25 is carried to the exit roll 84 via the carrying roll 85 and the reverse carrying roll 82 and is output to the exit tray 26 in a face-up state (a state where the toner image is upward). In addition, when the recording material S is carried to the branch carrying path 24*d* under a state where the side exit tray (not shown) or the post-processing apparatus (not shown) are disposed, the recording material, which passed through the fixing unit 25, is carried to the exit roll 86 via the carrying roll 85 and the reverse carrying roll 82 and is output to the side exit tray (where the toner image is output in a downward face-down state) or the post-processing apparatus.

In addition, when a double sided recording mode is selected, the recording material S having one side recorded, which passed through the fixing unit, is once stopped under a state where a trail edge portion of the recording material S is nipped by the reverse carrying roll 82 on the normal carrying path 24, is reversely carried to the reverse carrying roll 82 by reversing the reverse carrying roll 82, and then, is returned to the secondary transfer region of the image generating engine 21. At this time, in the image generating engine 21, the color component toner images of the other side of the recording material S are formed and transferred on the other side of the recording material S at the secondary transfer region. Thereafter, the recording material S is introduced into the fixing unit 25 via the carrying belt 81, and then, after the other side toner images are fused by the fixing unit 25, is introduced into the exit tray 26, for example.

In the above-described image generating process, although the heat generated from the fixing unit 25 is effectively shielded by the heat shield covers 102 and 108, it may leak out of the fixing unit 25 from the path in the fixing unit through which the recording material S passes or from a part of the heat shield covers 102 and 108.

Then, although some of the heat from the fixing unit 25 moves upward, as indicated by A in FIG. 5, the upper supply tray 22 disposed immediately above the fixing unit 25 and the recording material S accommodated in the upper supply tray 22 are preliminarily heated by the heat from the fixing unit 25. In this case, since the preliminarily heated recording material S is carried to the fixing unit 25, heat dispossessed by the recording material S from the heat roll 106 of the fixing unit 25 can be reduced, which leads to reduction of thermal energy consumption by the fixing unit 25. In addition, since the heat from the fixing unit 25 is used as a preliminary heat source, there is little need to provide a heat and air exhaust pan for exhausting heat.

Since the fixing unit 25 is disposed near the center Mc of the apparatus case body 20, a distance between the fixing unit 25 and the sidewalls M1 and M2 (having atmospheric environment temperature conditions) of the apparatus case body 20 is elongated, as indicated by B in FIG. 5. Accordingly, the heat from the fixing unit 25 does not nearly leak to the outside via the sidewalls M1 and M2 of the apparatus case body 20.

Accordingly, the unnecessary thermal energy consumption of the fixing unit 25 can be effectively suppressed, which leads to the improvement of thermal energy efficiency of the fixing unit 25.

Although most of the heat leaked from the fixing unit 25 moves upward, some of the heat moves downward, as indicated by C in FIG. 5.

However, in this embodiment, since the image forming units 30 (30*a* to 30*d*) are disposed in the opposite side of the fixing unit 25 (at a downward side in this embodiment) via the intermediate transfer belt 50, the heat from the fixing unit 25 is shielded by the intermediate transfer belt 50, with little effect of the heat from the fixing unit 25 on the image forming units 30. Accordingly, there is little possibility that the toner accommodated in the developing unit 34 is deteriorated due to its local cohesion by heat, and hence, image quality is deteriorated or the lifetime of the developing agent becomes shortened.

In this embodiment, since the intermediate transfer belt 50 is disposed above the image forming units 30, it can be prevented that the image quality is deteriorated due to contamination of the image forming units 30 by, for example, toner floating from the developing unit 34. Accordingly, images with more stable image quality can be reliably formed.

Particularly, in this embodiment, since the image generating engine 21 is obliquely disposed, the dimension in the horizontal direction of FIG. 5 of the image generating engine 21 can be selected to be small. Accordingly, an installation area of the apparatus case body 20 can be reduced.

Since the image generating engine 21 can be freely moved around the rotating support axis 55, when the recording material S is jammed at a location between the image generating engine 21 and the secondary transfer region, for example, the jam can be processed by moving and retreating the image generating engine 21 downward around the rotating support axis 55.

In this embodiment, since the fixing unit 25 is disposed near the center Mc of the apparatus case body 20, the length of the normal carrying path 24*a* from the upper supply tray 22 to the fixing unit 25 may be set to be relatively short. Accordingly, as the distance between the secondary transfer region of the image generating engine 21 and the thermal fusing unit HP of the fixing unit 25 becomes small, the non-fused toner images of the recording material S transferred by the image generating engine 21 pass through the thermal fusing unit HP of the fixing unit 25 and are fused with a relatively fast timing. Accordingly, the distance by which the recording material S is carried while maintaining the non-fused toner images is suppressed to be small, and accordingly, it can be effectively prevented that the non-fused toner images of the recording material S are disordered in the course of carrying the recording material S.

Since the length of the carrying path from the upper supply tray 22 to the fixing unit 25 becomes shortened, FCOT can be shortened when the distance between the fixing unit 25 and the exit tray 26 or the side exit tray is designed to be minimal.

Particularly, in this embodiment, since the fixing unit 25 is disposed near the secondary transfer region of the image generating engine 21, with respect to the center Mc of the apparatus case body 20, by increasing an exit speed of the recording material S after the recording material S comes out of the thermal fusing unit HP, FCOT can be set to be shorter, and moreover, a space at the downstream of the fixing unit 25 of a space of the apparatus case body 20 can be secured. Accordingly, the toner cartridges 41 (41*a* to 41*d*) of the toner replenishing units 40 (40*a* to 40*d*) can be spaced apart to some extent from the fixing unit 25. Accordingly, it is advantageous in that the toner accommodated in the toner cartridges 41 is not nearly affected by the heat from the fixing unit 25.

In this embodiment, the upper supply tray 22 is disposed above the image generating engine 21 and the fixing unit 25, that is, on the upper portion of the apparatus case body 20. Under this state, a user can replenish the upper supply tray 22 with the recording material S while standing, thereby the replenishing operation of the recording material S can be simpler than that of the recording material S for the supply tray provided in the lower region of the apparatus case body 20.

In this embodiment, although the fixing unit 25 may be widely applied independently of whether or not it requires a standby mode, the fixing unit 25 of a so-called instant-on type not requiring the standby mode is advantageous in the following respects.

When the instant-on type fixing unit 25 is used, since heat can be generated only when the image formation operation is performed, heat generated when the fixing unit 25 is operated can be absorbed in the upper supply tray 22 and the recording material D accommodated in the upper supply tray 22, without generating unnecessary heat in the fixing unit 25. In this case, since the ambient environments of the fixing unit 25 do not go in abnormal high temperature conditions, there is no need to provide a heat and air exhaust fan for exhausting heat. If the heat and air exhaust fan is provided, since there is a need to make ventilators in the apparatus case body 20, there is a fear that sound escapes from the ventilators. Therefore, when such a fan is not provided, a soundproofing effect of the image forming apparatus can be further enhanced.

Figure 6A:
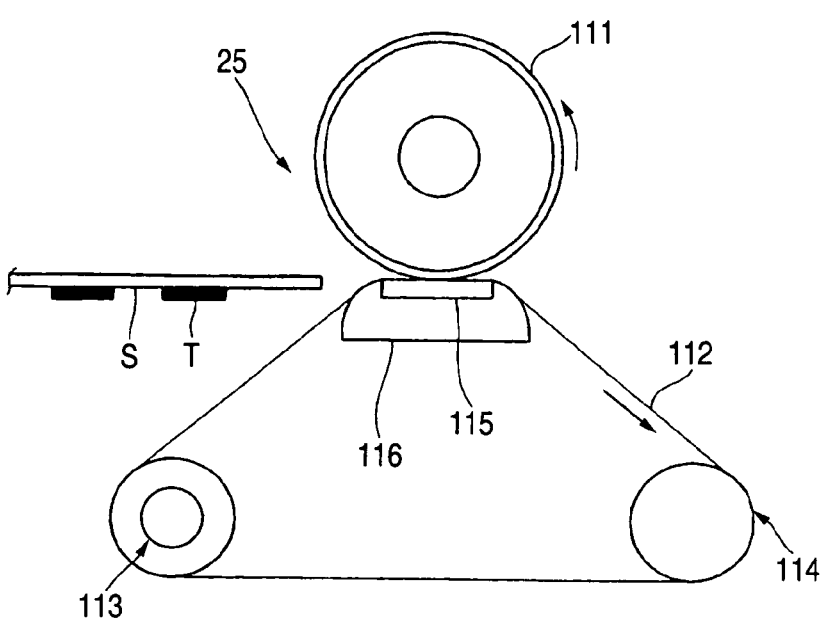
FIGS. 6A and 6B are explanatory diagrams illustrating an example of an instant-on type fixing unit.

Herein, a typical aspect of the instant-on type fixing unit 25 includes one in which a pressing roll 111 and a fusing belt 112 are disposed in such a manner that the pressing roll 111 can be rotated contacting with the fusing belt 112, the fusing belt 112 is placed on a driving roll 113, an idle roll 114, and a heater 115 (for example, a linear heater having low thermal capacity) supported on a heater support 116, and the fusing belt 112 is nipped and carried between the heater 115 and the pressing roll 111, as shown in FIG. 6A.

Figure 6B:
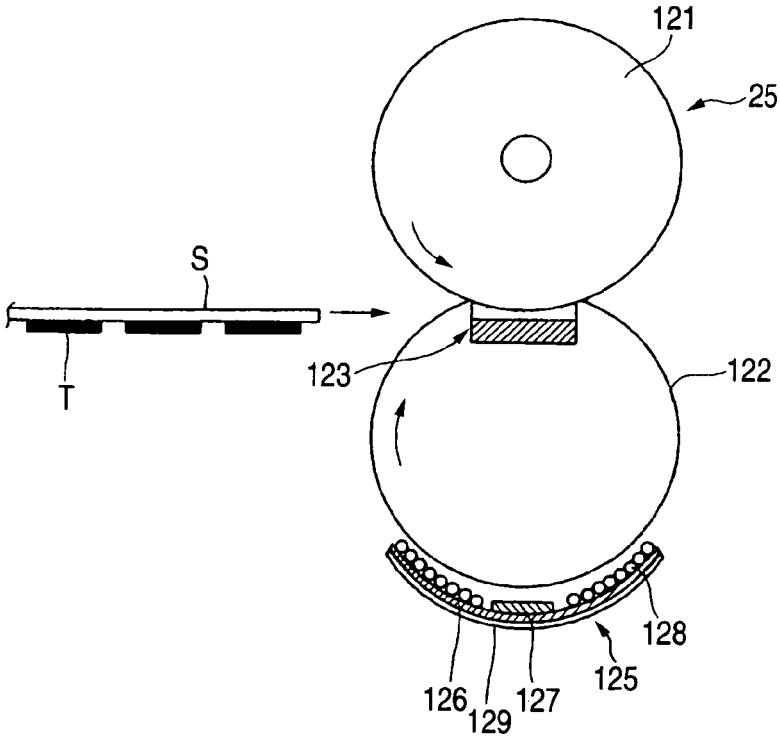

An another aspect of the instant-on type fixing unit 25 includes one in which a pressing roll 121 and a fusing belt 122 are disposed in such a manner that the pressing roll 121 can be rotated contacting with the fusing belt 122, an elastic pad 123 is disposed in the fusing belt 122 corresponding to a nip region between the pressing roll 121 and the fusing belt 122, the pressing roll 121 is driven by a driving source (not shown), the fusing belt 122 is driven according to the driving of the pressing roll 121, a base layer, an electromagnetic inductive heat generating layer (material generating heat by the electromagnetic induction, for example, copper, silver, aluminum, or equivalent heat resistant organic conductors, etc), and a surface release layer are provided in the fusing belt 122, and a heater 125 is disposed on the opposite side, for example, of the nip region of the fusing belt 122, as shown in FIG. 6B. Here, the heater 125 includes, for example, a pedestal 126 having a shape corresponding to a bent shape of the fusing belt 122, a magnetic core 127 disposed at a approximate center in the pedestal 126, such as ferrite, an exciting coil 128 wound on the magnetic core 127 for applying a variation magnetic field toward the thickness direction of the fusing belt 122, and a magnetic field shield plate 129 for shielding the magnetic field directing toward the outside of the pedestal 126.

In FIGS. 6A and 6B, reference numeral T denotes a non-fused toner on the recording material S.

Figure 7:
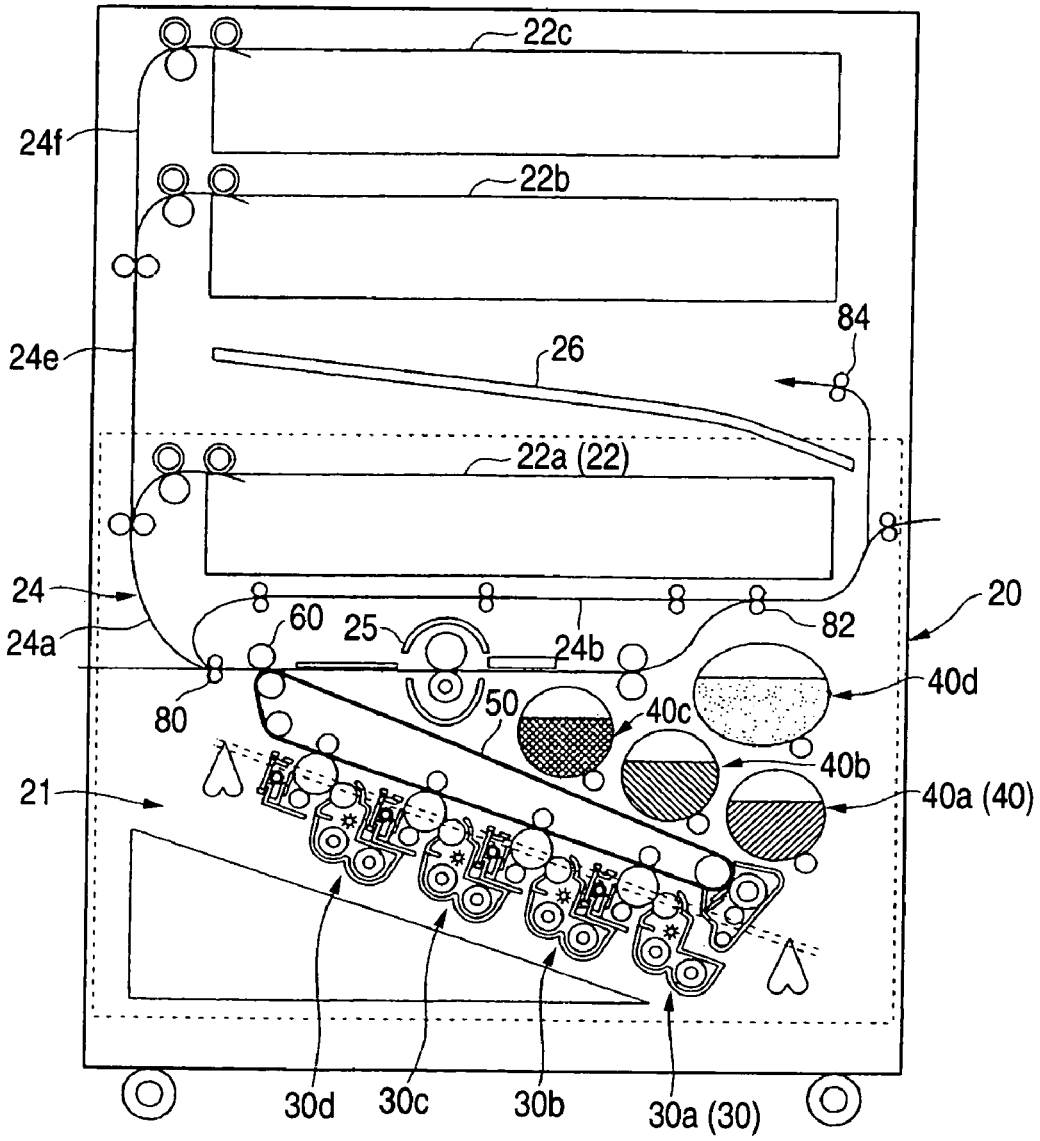
FIG. 7 is an explanatory diagram illustrating a modification of the image forming apparatus according to the first embodiment.

Although one upper supply tray 22 is provided in this embodiment, the present invention is not limited to this, and may have plural upper supply trays 22 (22*a* to 22*c*), as shown in FIG. 7. In this case, the plural upper supply trays 22 (22*a* to 22*c*) may be regularly equipped in advance or may be optionally added.

In FIG. 7, the image forming apparatus includes a first upper supply tray 22*a* disposed above the image generating engine 21 and the fixing unit 25, an exit tray 26 disposed above the first upper supply tray 22*a*, and second and third upper supply trays 22*b* and 22*c* disposed above the exit tray 26. Herein, the same elements as in FIG. 2 are denoted by the same reference numerals, and detailed explanation thereof will be omitted. In FIG. 7, reference numeral 24*e* denotes a connection carrying path extending from the second upper supply tray 22*b* to the normal carrying path 24*a*, and reference numeral 24*f* denotes a connection carrying path extending from the third upper supply tray 22*c* to the connection carrying path 24*e*.

Figure 8:
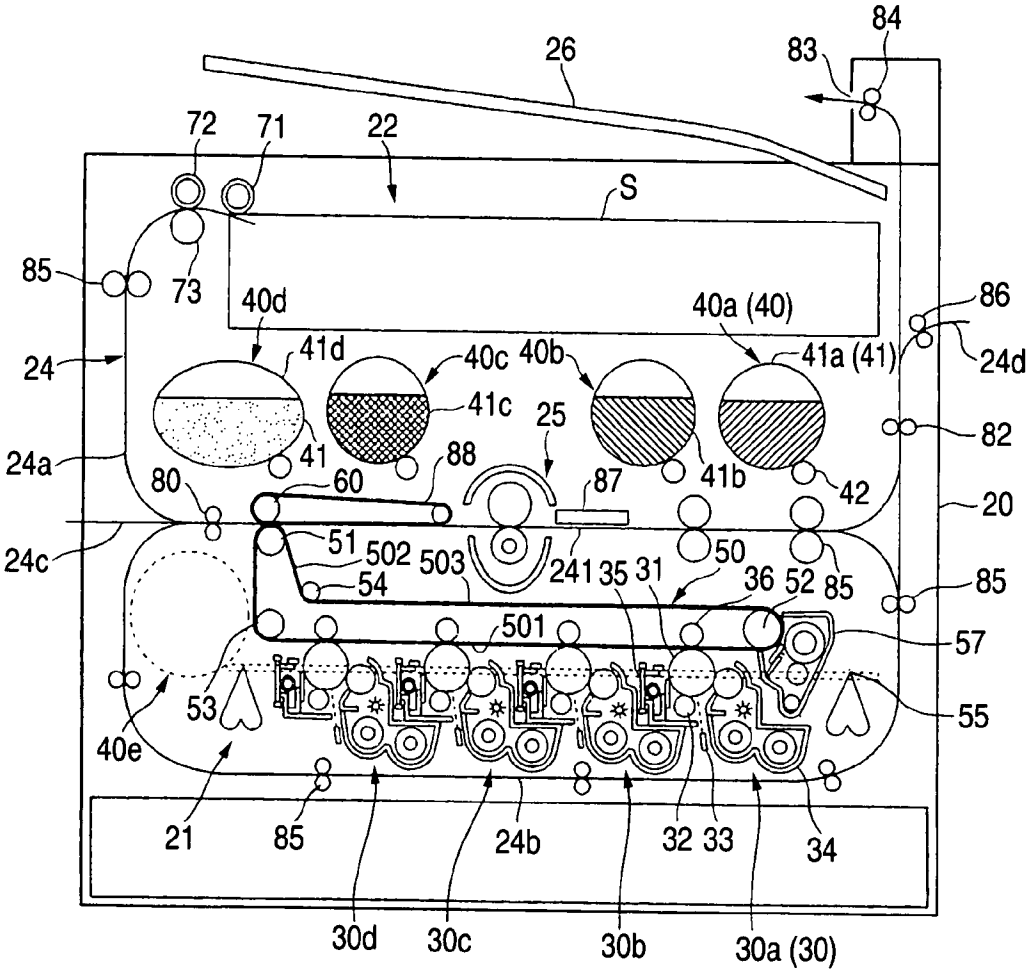
FIG. 8 is an explanatory diagram illustrating an image forming apparatus according to a second embodiment.

FIG. 8 is a diagram illustrating a second embodiment of an image forming apparatus to which the present invention is applied.

In the figure, the image forming apparatus according to the second embodiment has approximately the same basic configuration as in the first embodiment in that the upper supply tray 22 is disposed above the image generating engine 21, and the fixing unit 25 is disposed near the center (at an approximate center in this embodiment) of the apparatus case body 20 between the upper supply tray 22 and the image generating engine 21, except that the configuration of the image generating engine 21 and the layout of the carrying path 24 of the recording material S are partially modified. Herein, the same elements as in the first embodiment are denoted by the same reference numerals, and detailed explanation thereof will be omitted.

In this embodiment, the image generating engine 21 has four color component image forming units 30 (30*a* to 30*d*) below the intermediate transfer belt 50, in the same way as in the first embodiment. However, unlike the first embodiment, the intermediate transfer belt 50 is hung by three inner hanger rolls 51 to 53 and one outer hanger roll 54, a belt portion placed between the hanger rolls 52 and 53 is formed as a lower horizontal plane 501, a belt portion placed on the hanger rolls 51, 52 and 54 is formed as a projection 502 projecting upward, a belt portion placed between the hanger rolls 51 and 54 is formed as an upper horizontal plane 503, and the upper horizontal plane 503 is displaced to a downward side with respect to the top of the projection 502, so that a space for disposition of the fixing unit 25 is secured. In addition, the image forming units 30 are approximately horizontally arranged in parallel along the lower horizontal plane of the intermediate transfer belt 50.

In this embodiment, four toner cartridges 41(41*a* to 41*d*) of the toner replenishing units 40(40*a* to 40*d*) are horizontally disposed at a region except the surroundings of an upper region of the fixing unit, in a space between the fixing unit 25 and the upper supply tray 22. Reference numeral 40*e* indicated by a dotted line in the figure denotes a reserved disposition space of the toner replenishing unit, which can be used, for example, when a black toner cartridge is to be added.

In this embodiment, the secondary transfer unit 60 is composed of the secondary transfer roll, which also serves as a hanger roll of a carrying belt 88, and is disposed opposite to the hanger roll 51 of the intermediate transfer belt 50. Particularly, in this embodiment, since the secondary transfer unit 60 is carried along the carrying belt 88 while transferring the color image toner images on the intermediate transfer belt 50 on the recording material S, the transfer performance of the toner images is advantageously maintained and there is no fear of damage to the peeling performance of the recording material S.

In this embodiment, a reverse carrying path 24*b* is traversely formed in a lower region of the image generating engine 21.

Accordingly, in approximately the same way as in the first embodiment, the second embodiment has effects of (1) preliminarily heating the recording material S accommodated in the upper supply tray 22 by the fixing unit 25, (2) reducing the amount of heat exhaust to the outside of the apparatus case body 20 by the fixing unit 25, (3) shielding heat toward the image forming units 30 by the heat the fixing unit 25, (4) reduction of FCOT, (5) improvement of the replenishing workability on the recording material with respect to the upper supply tray 22.

Figure 9:
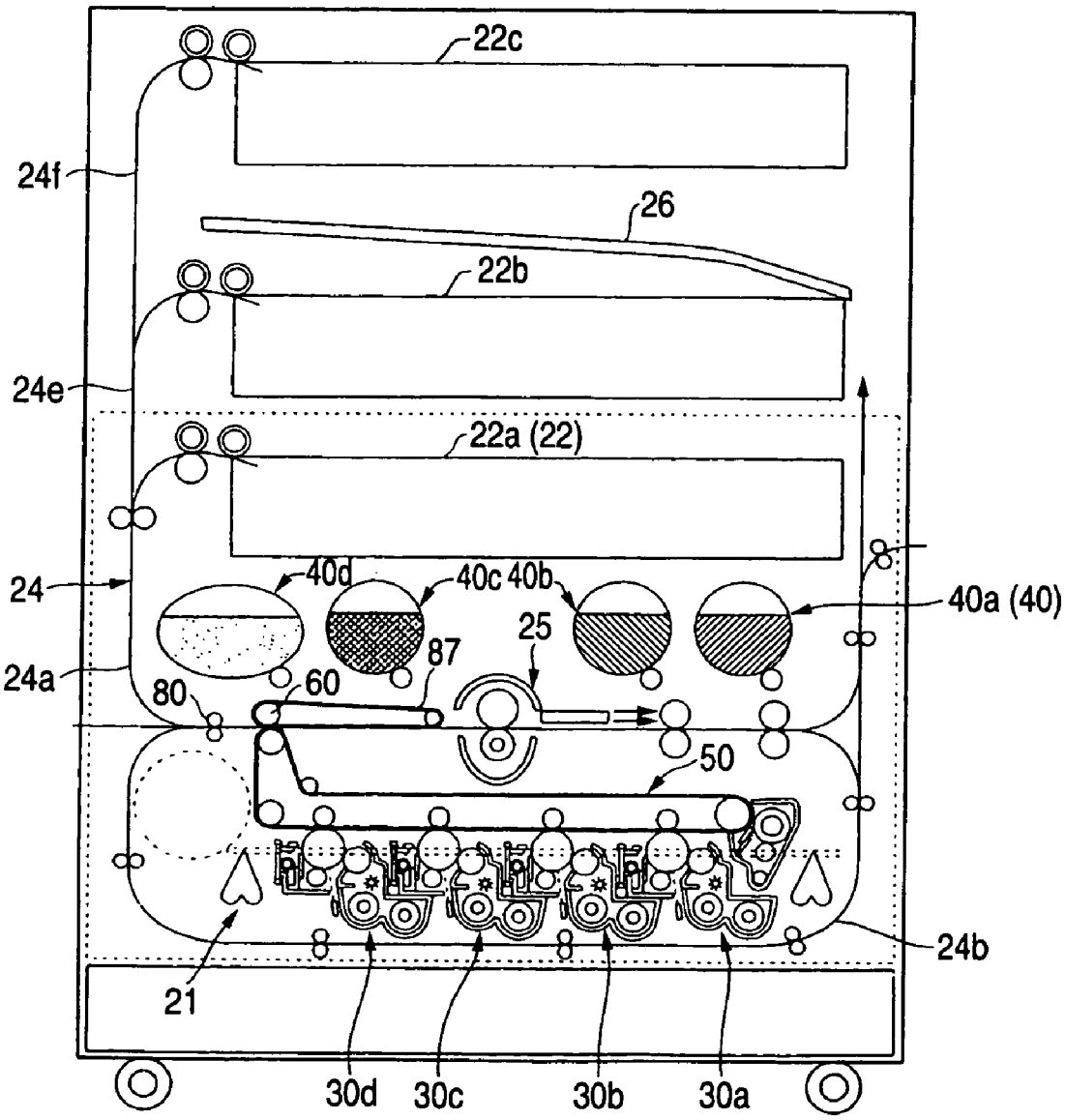
FIG. 9 is an explanatory diagram illustrating a modification of the image forming apparatus according to the second embodiment.
Figure 10:
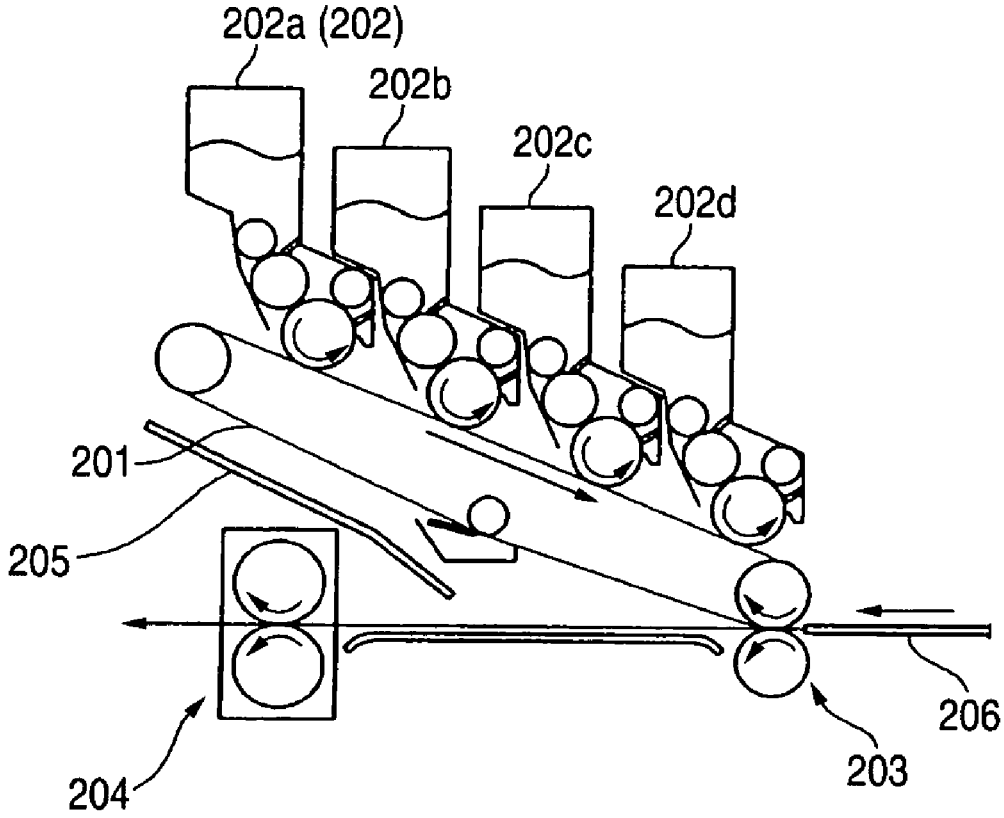
FIG. 10 RELATED ART
FIG. 10 is an explanatory diagram of a conventional image forming apparatus.

In this embodiment, the so-called instant-on type fixing unit (for example, see FIG. 6) is used as the fixing unit 25, or the upper supply tray 22 may be arranged in plural, as shown in FIG. 9.

When the plural upper supply trays 22 (22*a* to 22*c*) are arranged, they may be configured as shown in FIG. 7, or, as shown in FIG. 9, the second upper supply tray 22*b* may be disposed above the first upper supply tray 22*a*, the exit tray 26 may be disposed above the second upper supply tray 22*b*, and the third upper supply tray 22*c* may be disposed above the exit tray 26.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2004-272468 filed on Sep. 17, 2004 including specification, claims, drawings and abstract is incorporated herein by reference in its entirety.

What is claimed is:

1. An image forming apparatus comprising:

an image generating engine comprising at least one image generating unit that forms a toner image, an intermediate transfer member onto which the toner image is primarily transferred, the intermediate transfer member disposed above the at least one image generating unit, and a transfer unit that secondly transfers the toner image onto a recording material;

a fixing unit having a heat source that thermally fixes the toner image transferred onto the recording material, the fixing unit being disposed at a position above the at least one image generating unit intervened with the intermediate transfer member and closer to a center of a casing of the image forming apparatus than to sidewalls of the casing; and at least one supply tray disposed above the fixing unit, which accommodates the recording material to be fed to the transfer unit.

2. The image forming apparatus according to claim 1, wherein the fixing unit is disposed closer to the transfer unit than to the center of the casing.

3. The image forming apparatus according to claim 1, wherein a feeding direction of the recording material from the supply tray is opposite to an exit direction of the recording material from the fixing unit.

4. The image forming apparatus according to claim 1, wherein a carrying path of the recording material is disposed between the at least one supply tray and the intermediate transfer member.

5. The image forming apparatus according to claim 1, further comprising an exit tray disposed downstream of the fixing unit for the recording material, the exit tray being disposed above the at least one supply tray.

6. The image forming apparatus according to claim 4, wherein the carrying path has a reverse carrying path branching downstream of the fixing unit and being disposed between the at least one supply tray and the fixing unit, and the recording material having been reversed is returned to the transfer unit through the reverse carrying path.

7. The image forming apparatus according to claim 1, wherein the transfer unit is disposed at a highest position of the image generating unit, and a transfer nip in the transfer unit and a fixing nip in the fixing unit are disposed substantially horizontally.

8. The image forming apparatus according to claim 1, wherein the intermediate transfer member is an endless belt.

9. The image forming apparatus according to claim 8, wherein the intermediate transfer member is obliquely disposed with respect to the casing so that a portion of the intermediate transfer member closest to a feeding side of the at least one supply tray is positioned higher than a portion thereof farthest from the feeding side of the at least one supply tray.

10. The image forming apparatus according to claim 1, wherein the fixing unit is an instant-on fixing unit.

11. The image forming apparatus according to claim 1, wherein the at least one supply tray and the fixing unit are at least partially overlapping when viewed from the vertical direction.

* * * * *